US008886525B2

(12) United States Patent
Klein

(10) Patent No.: US 8,886,525 B2
(45) **Date of Patent: *Nov. 11, 2014**

(54) SYSTEM AND METHOD FOR ADAPTIVE INTELLIGENT NOISE SUPPRESSION

(75) Inventor: David Klein, Los Altos, CA (US)

(73) Assignee: Audience, Inc., Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/426,436

(22) Filed: Mar. 21, 2012

(65) Prior Publication Data

US 2012/0179462 A1 Jul. 12, 2012

Related U.S. Application Data

(63) Continuation of application No. 11/825,563, filed on Jul. 6, 2007.

(51) Int. Cl.
*G10L 21/02* (2013.01)
*G10L 21/0208* (2013.01)
*G10L 21/0216* (2013.01)

(52) U.S. Cl.
CPC ... *G10L 21/0208* (2013.01); *G10L 2021/02165* (2013.01)
USPC ..... 704/226

(58) Field of Classification Search
USPC ..... 704/226–228
See application file for complete search history.

(56) References Cited

U.S. PATENT DOCUMENTS

| | | | |
|---|---|---|---|
| 3,976,863 | A | 8/1976 | Engel |
| 3,978,287 | A | 8/1976 | Fletcher et al. |
| 4,137,510 | A | 1/1979 | Iwahara |
| 4,433,604 | A | 2/1984 | Ott |
| 4,516,259 | A | 5/1985 | Yato et al. |
| 4,535,473 | A | 8/1985 | Sakata |
| 4,536,844 | A | 8/1985 | Lyon |
| 4,581,758 | A | 4/1986 | Coker et al. |
| 4,628,529 | A | 12/1986 | Borth et al. |
| 4,630,304 | A | 12/1986 | Borth et al. |
| 4,649,505 | A | 3/1987 | Zinser, Jr. et al. |
| 4,658,426 | A | 4/1987 | Chabries et al. |
| 4,674,125 | A | 6/1987 | Carlson et al. |
| 4,718,104 | A | 1/1988 | Anderson |

(Continued)

FOREIGN PATENT DOCUMENTS

| | | |
|---|---|---|
| JP | 62110349 | 5/1987 |
| JP | 4184400 | 7/1992 |

(Continued)

OTHER PUBLICATIONS

Mokbel et al, (1995, IEEE Transactions of Speech and Audio Processing, vol. 3, No. 5, Sep. 1995, pp. 346-356).*

(Continued)

*Primary Examiner* — Angela A Armstrong
(74) *Attorney, Agent, or Firm* — Carr & Ferrell LLP

(57) ABSTRACT

Systems and methods for adaptive intelligent noise suppression are provided. In exemplary embodiments, a primary acoustic signal is received. A speech distortion estimate is then determined based on the primary acoustic signal. The speech distortion estimate is used to derive control signals which adjust an enhancement filter. The enhancement filter is used to generate a plurality of gain masks, which may be applied to the primary acoustic signal to generate a noise suppressed signal.

19 Claims, 8 Drawing Sheets

(56) References Cited

U.S. PATENT DOCUMENTS 4,811,404 A 3/1989 Vilmur et al.
4,812,996 A 3/1989 Stubbs
4,864,620 A 9/1989 Bialick
4,920,508 A 4/1990 Yassaie et al.
5,027,410 A 6/1991 Williamson et al.
5,054,085 A 10/1991 Meisel et al.
5,058,419 A 10/1991 Nordstrom et al.
5,099,738 A 3/1992 Hotz
5,119,711 A 6/1992 Bell et al.
5,142,961 A 9/1992 Paroutaud
5,150,413 A 9/1992 Nakatani et al.
5,175,769 A 12/1992 Hejna, Jr. et al.
5,187,776 A 2/1993 Yanker
5,208,864 A 5/1993 Kaneda
5,210,366 A 5/1993 Sykes, Jr.
5,224,170 A 6/1993 Waite, Jr.
5,230,022 A 7/1993 Sakata
5,319,736 A 6/1994 Hunt
5,323,459 A 6/1994 Hirano
5,341,432 A 8/1994 Suzuki et al.
5,381,473 A 1/1995 Andrea et al.
5,381,512 A 1/1995 Holton et al.
5,400,409 A 3/1995 Linhard
5,402,493 A 3/1995 Goldstein
5,402,496 A 3/1995 Soli et al.
5,471,195 A 11/1995 Rickman
5,473,702 A 12/1995 Yoshida et al.
5,473,759 A 12/1995 Slaney et al.
5,479,564 A 12/1995 Vogten et al.
5,502,663 A 3/1996 Lyon
5,544,250 A 8/1996 Urbanski
5,574,824 A 11/1996 Slyh et al.
5,583,784 A 12/1996 Kapust et al.
5,587,998 A 12/1996 Velardo, Jr. et al.
5,590,241 A 12/1996 Park et al.
5,602,962 A 2/1997 Kellermann
5,675,778 A 10/1997 Jones
5,682,463 A 10/1997 Allen et al.
5,694,474 A 12/1997 Ngo et al.
5,706,395 A 1/1998 Arslan et al.
5,717,829 A 2/1998 Takagi
5,729,612 A 3/1998 Abel et al.
5,732,189 A 3/1998 Johnston et al.
5,749,064 A 5/1998 Pawate et al.
5,757,937 A 5/1998 Itoh et al.
5,792,971 A 8/1998 Timis et al.
5,796,819 A 8/1998 Romesburg
5,806,025 A 9/1998 Vis et al.
5,809,463 A 9/1998 Gupta et al.
5,825,320 A 10/1998 Miyamori et al.
5,839,101 A 11/1998 Vahatalo et al.
5,920,840 A 7/1999 Satyamurti et al.
5,933,495 A 8/1999 Oh
5,943,429 A 8/1999 Handel
5,956,674 A 9/1999 Smyth et al.
5,974,380 A 10/1999 Smyth et al.
5,978,824 A 11/1999 Ikeda
5,983,139 A 11/1999 Zierhofer
5,990,405 A 11/1999 Auten et al.
6,002,776 A 12/1999 Bhadkamkar et al.
6,061,456 A 5/2000 Andrea et al.
6,072,881 A 6/2000 Linder
6,097,820 A 8/2000 Turner
6,108,626 A 8/2000 Cellario et al.
6,122,610 A 9/2000 Isabelle
6,134,524 A 10/2000 Peters et al.
6,137,349 A 10/2000 Menkhoff et al.
6,140,809 A 10/2000 Doi
6,173,255 B1 1/2001 Wilson et al.
6,180,273 B1 1/2001 Okamoto
6,216,103 B1 4/2001 Wu et al.
6,222,927 B1 4/2001 Feng et al.
6,223,090 B1 4/2001 Brungart
6,226,616 B1 5/2001 You et al.
6,263,307 B1 7/2001 Arslan et al.
6,266,633 B1 7/2001 Higgins et al.
6,317,501 B1 11/2001 Matsuo
6,339,758 B1 1/2002 Kanazawa et al.
6,355,869 B1 3/2002 Mitton
6,363,345 B1 3/2002 Marash et al.
6,381,570 B2 4/2002 Li et al.
6,430,295 B1 8/2002 Handel et al.
6,434,417 B1 8/2002 Lovett
6,449,586 B1 9/2002 Hoshuyama
6,469,732 B1 10/2002 Chang et al.
6,487,257 B1 11/2002 Gustafsson et al.
6,496,795 B1 12/2002 Malvar
6,513,004 B1 1/2003 Rigazio et al.
6,516,066 B2 2/2003 Hayashi
6,529,606 B1 3/2003 Jackson, Jr. II et al.
6,549,630 B1 4/2003 Bobisuthi
6,584,203 B2 6/2003 Elko et al.
6,622,030 B1 9/2003 Romesburg et al.
6,717,991 B1 4/2004 Gustafsson et al.
6,718,309 B1 4/2004 Selly
6,738,482 B1 5/2004 Jaber
6,760,450 B2 7/2004 Matsuo
6,785,381 B2 8/2004 Gartner et al.
6,792,118 B2 9/2004 Watts
6,795,558 B2 9/2004 Matsuo
6,798,886 B1 9/2004 Smith et al.
6,810,273 B1 10/2004 Mattila et al.
6,882,736 B2 4/2005 Dickel et al.
6,915,264 B2 7/2005 Baumgarte
6,917,688 B2 7/2005 Yu et al.
6,944,510 B1 9/2005 Ballesty et al.
6,978,159 B2 12/2005 Feng et al.
6,982,377 B2 1/2006 Sakurai et al.
6,999,582 B1 2/2006 Popovic et al.
7,016,507 B1 3/2006 Brennan
7,020,605 B2 3/2006 Gao
7,031,478 B2 4/2006 Belt et al.
7,054,452 B2 5/2006 Ukita
7,065,485 B1 6/2006 Chong-White et al.
7,076,315 B1 7/2006 Watts
7,092,529 B2 8/2006 Yu et al.
7,092,882 B2 8/2006 Arrowood et al.
7,099,821 B2 8/2006 Visser et al.
7,142,677 B2 11/2006 Gonopolskiy et al.
7,146,316 B2 12/2006 Alves
7,155,019 B2 12/2006 Hou
7,164,620 B2 1/2007 Hoshuyama
7,171,008 B2 1/2007 Elko
7,171,246 B2 1/2007 Mattila et al.
7,174,022 B1 2/2007 Zhang et al.
7,206,418 B2 4/2007 Yang et al.
7,209,567 B1 4/2007 Kozel et al.
7,225,001 B1 5/2007 Eriksson et al.
7,242,762 B2 7/2007 He et al.
7,246,058 B2 7/2007 Burnett
7,254,242 B2 8/2007 Ise et al.
7,359,520 B2 4/2008 Brennan et al.
7,412,379 B2 8/2008 Taori et al.
7,433,907 B2 10/2008 Nagai et al.
7,555,434 B2 6/2009 Nomura et al.
7,617,099 B2 11/2009 Yang et al.
7,949,522 B2 5/2011 Hetherington et al.
8,098,812 B2 1/2012 Fadili et al.
2001/0016020 A1 8/2001 Gustafsson et al.
2001/0031053 A1 10/2001 Feng et al.
2002/0002455 A1 1/2002 Accardi et al.
2002/0009203 A1 1/2002 Erten
2002/0041693 A1 4/2002 Matsuo
2002/0080980 A1 6/2002 Matsuo
2002/0106092 A1 8/2002 Matsuo
2002/0116187 A1 8/2002 Erten
2002/0133334 A1 9/2002 Coorman et al.
2002/0147595 A1 10/2002 Baumgarte
2002/0184013 A1 12/2002 Walker
2003/0014248 A1 1/2003 Vetter
2003/0026437 A1 2/2003 Janse et al.
2003/0033140 A1 2/2003 Taori et al.
2003/0039369 A1 2/2003 Bullen
2003/0040908 A1 2/2003 Yang et al.

(56) References Cited

U.S. PATENT DOCUMENTS

| | | | |
|---|---|---|---|
| 2003/0061032 A1 | 3/2003 | Gonopolskiy | |
| 2003/0063759 A1 | 4/2003 | Brennan et al. | |
| 2003/0072382 A1 | 4/2003 | Raleigh et al. | |
| 2003/0072460 A1 | 4/2003 | Gonopolskiy et al. | |
| 2003/0095667 A1 | 5/2003 | Watts | |
| 2003/0099345 A1 | 5/2003 | Gartner et al. | |
| 2003/0101048 A1 | 5/2003 | Liu | |
| 2003/0103632 A1 | 6/2003 | Goubran et al. | |
| 2003/0128851 A1* | 7/2003 | Furuta | 381/94.2 |
| 2003/0138116 A1 | 7/2003 | Jones et al. | |
| 2003/0147538 A1 | 8/2003 | Elko | |
| 2003/0169891 A1 | 9/2003 | Ryan et al. | |
| 2003/0228023 A1 | 12/2003 | Burnett et al. | |
| 2004/0013276 A1 | 1/2004 | Ellis et al. | |
| 2004/0047464 A1 | 3/2004 | Yu et al. | |
| 2004/0057574 A1 | 3/2004 | Faller | |
| 2004/0078199 A1 | 4/2004 | Kremer et al. | |
| 2004/0131178 A1 | 7/2004 | Shahaf et al. | |
| 2004/0133421 A1 | 7/2004 | Burnett et al. | |
| 2004/0165736 A1 | 8/2004 | Hetherington et al. | |
| 2004/0196989 A1 | 10/2004 | Friedman et al. | |
| 2004/0263636 A1 | 12/2004 | Cutler et al. | |
| 2005/0025263 A1 | 2/2005 | Wu | |
| 2005/0027520 A1* | 2/2005 | Mattila et al. | 704/228 |
| 2005/0049864 A1 | 3/2005 | Kaltenmeier et al. | |
| 2005/0060142 A1 | 3/2005 | Visser et al. | |
| 2005/0152559 A1 | 7/2005 | Gierl et al. | |
| 2005/0185813 A1 | 8/2005 | Sinclair et al. | |
| 2005/0213778 A1 | 9/2005 | Buck et al. | |
| 2005/0216259 A1 | 9/2005 | Watts | |
| 2005/0228518 A1 | 10/2005 | Watts | |
| 2005/0276423 A1 | 12/2005 | Aubauer et al. | |
| 2005/0288923 A1 | 12/2005 | Kok | |
| 2006/0072768 A1 | 4/2006 | Schwartz et al. | |
| 2006/0074646 A1 | 4/2006 | Alves et al. | |
| 2006/0098809 A1 | 5/2006 | Nongpiur et al. | |
| 2006/0120537 A1 | 6/2006 | Burnett et al. | |
| 2006/0133621 A1 | 6/2006 | Chen et al. | |
| 2006/0149535 A1 | 7/2006 | Choi et al. | |
| 2006/0160581 A1 | 7/2006 | Beaugeant et al. | |
| 2006/0184363 A1 | 8/2006 | McCree et al. | |
| 2006/0198542 A1 | 9/2006 | Benjelloun Touimi et al. | |
| 2006/0222184 A1 | 10/2006 | Buck et al. | |
| 2007/0021958 A1 | 1/2007 | Visser et al. | |
| 2007/0027685 A1 | 2/2007 | Arakawa et al. | |
| 2007/0033020 A1 | 2/2007 | (Kelleher) Francois et al. | |
| 2007/0067166 A1 | 3/2007 | Pan et al. | |
| 2007/0078649 A1 | 4/2007 | Hetherington et al. | |
| 2007/0094031 A1 | 4/2007 | Chen | |
| 2007/0100612 A1 | 5/2007 | Ekstrand et al. | |
| 2007/0116300 A1 | 5/2007 | Chen | |
| 2007/0150268 A1 | 6/2007 | Acero et al. | |
| 2007/0154031 A1 | 7/2007 | Avendano et al. | |
| 2007/0165879 A1 | 7/2007 | Deng et al. | |
| 2007/0195968 A1 | 8/2007 | Jaber | |
| 2007/0230712 A1 | 10/2007 | Belt et al. | |
| 2007/0276656 A1 | 11/2007 | Solbach et al. | |
| 2008/0019548 A1 | 1/2008 | Avendano | |
| 2008/0033723 A1 | 2/2008 | Jang et al. | |
| 2008/0140391 A1 | 6/2008 | Yen et al. | |
| 2008/0201138 A1 | 8/2008 | Visser et al. | |
| 2008/0228478 A1 | 9/2008 | Hetherington et al. | |
| 2008/0260175 A1 | 10/2008 | Elko | |
| 2009/0012783 A1 | 1/2009 | Klein | |
| 2009/0012786 A1 | 1/2009 | Zhang et al. | |
| 2009/0129610 A1 | 5/2009 | Kim et al. | |
| 2009/0220107 A1 | 9/2009 | Every et al. | |
| 2009/0238373 A1 | 9/2009 | Klein | |
| 2009/0253418 A1 | 10/2009 | Makinen | |
| 2009/0271187 A1 | 10/2009 | Yen et al. | |
| 2009/0323982 A1 | 12/2009 | Solbach et al. | |
| 2010/0094643 A1 | 4/2010 | Avendano et al. | |
| 2010/0278352 A1 | 11/2010 | Petit et al. | |
| 2011/0178800 A1 | 7/2011 | Watts | |
| 2012/0121096 A1 | 5/2012 | Chen et al. | |
| 2012/0140917 A1 | 6/2012 | Nicholson et al. | |

FOREIGN PATENT DOCUMENTS

| | | |
|---|---|---|
| JP | 5053587 | 3/1993 |
| JP | 05-172865 | 7/1993 |
| JP | 6269083 | 9/1994 |
| JP | 10-313497 | 11/1998 |
| JP | 11-249693 | 9/1999 |
| JP | 2004053895 | 2/2004 |
| JP | 2004531767 | 10/2004 |
| JP | 2004533155 | 10/2004 |
| JP | 2005110127 | 4/2005 |
| JP | 2005148274 | 6/2005 |
| JP | 2005518118 | 6/2005 |
| JP | 2005195955 | 7/2005 |
| WO | 01/74118 | 10/2001 |
| WO | 02080362 | 10/2002 |
| WO | 02103676 | 12/2002 |
| WO | 03/043374 | 5/2003 |
| WO | 03/069499 | 8/2003 |
| WO | 03069499 | 8/2003 |
| WO | 2004/010415 | 1/2004 |
| WO | 2007/081916 | 7/2007 |
| WO | 2007/140003 | 12/2007 |
| WO | 2010/005493 | 1/2010 |

OTHER PUBLICATIONS

Allen, Jont B. "Short Term Spectral Analysis, Synthesis, and Modification by Discrete Fourier Transform", IEEE Transactions on Acoustics, Speech, and Signal Processing. vol. ASSP-25, No. 3, Jun. 1977. pp. 235-238.

Allen, Jont B. et al. "A Unified Approach to Short-Time Fourier Analysis and Synthesis", Proceedings of the IEEE. vol. 65, No. 11, Nov. 1977. pp. 1558-1564.

Avendano, Carlos, "Frequency-Domain Source Identification and Manipulation in Stereo Mixes for Enhancement, Suppression and Re-Panning Applications," 2003 IEEE Workshop on Application of Signal Processing to Audio and Acoustics, Oct. 19-22, pp. 55-58, New Paltz, New York, USA.

Boll, Steven F. "Suppression of Acoustic Noise in Speech using Spectral Subtraction", IEEE Transactions on Acoustics, Speech and Signal Processing, vol. ASSP-27, No. 2, Apr. 1979, pp. 113-120.

Boll, Steven F. et al. "Suppression of Acoustic Noise in Speech Using Two Microphone Adaptive Noise Cancellation", IEEE Transactions on Acoustic, Speech, and Signal Processing, vol. ASSP-28, No. 6, Dec. 1980, pp. 752-753.

Boll, Steven F. "Suppression of Acoustic Noise in Speech Using Spectral Subtraction", Dept. of Computer Science, University of Utah Salt Lake City, Utah, Apr. 1979, pp. 18-19.

Chen, Jingdong et al. "New Insights into the Noise Reduction Wiener Filter", IEEE Transactions on Audio, Speech, and Language Processing. vol. 14, No. 4, Jul. 2006, pp. 1218-1234.

Cohen, Israel et al. "Microphone Array Post-Filtering for Non-Stationary Noise Suppression", IEEE International Conference on Acoustics, Speech, and Signal Processing, May 2002, pp. 1-4.

Cohen, Israel, "Multichannel Post-Filtering in Nonstationary Noise Environments", IEEE Transactions on Signal Processing, vol. 52, No. 5, May 2004, pp. 1149-1160.

Dahl, Mattias et al., "Simultaneous Echo Cancellation and Car Noise Suppression Employing a Microphone Array", 1997 IEEE International Conference on Acoustics, Speech, and Signal Processing, Apr. 21-24, pp. 239-242.

Elko, Gary W., "Chapter 2: Differential Microphone Arrays", "Audio Signal Processing for Next-Generation Multimedia Communication Systems", 2004, pp. 12-65, Kluwer Academic Publishers, Norwell, Massachusetts, USA.

"ENT 172." Instructional Module. Prince George's Community College Department of Engineering Technology. Accessed: Oct. 15, 2011. Subsection: "Polar and Rectangular Notation". <http://academic.ppgcc.edu/ent/ent172_instr_mod.html>.

(56) References Cited

OTHER PUBLICATIONS

Fuchs, Martin et al. "Noise Suppression for Automotive Applications Based on Directional Information", 2004 IEEE International Conference on Acoustics, Speech, and Signal Processing, May 17-21, pp. 237-240.
Fulghum, D. P. et al., "LPC Voice Digitizer with Background Noise Suppression", 1979 IEEE International Conference on Acoustics, Speech, and Signal Processing, pp. 220-223.
Goubran, R.A. "Acoustic Noise Suppression Using Regression Adaptive Filtering", 1990 IEEE 40th Vehicular Technology Conference, May 6-9, pp. 48-53.
Graupe, Daniel et al., "Blind Adaptive Filtering of Speech from Noise of Unknown Spectrum Using a Virtual Feedback Configuration", IEEE Transactions on Speech and Audio Processing, Mar. 2000, vol. 8, No. 2, pp. 146-158.
Haykin, Simon et al. "Appendix A.2 Complex Numbers." Signals and Systems. 2nd Ed. 2003. p. 764.
Hermansky, Hynek "Should Recognizers Have Ears?", In Proc. ESCA Tutorial and Research Workshop on Robust Speech Recognition for Unknown Communication Channels, pp. 1-10, France 1997.
Hohmann, V. "Frequency Analysis and Synthesis Using a Gammatone Filterbank", Acta Acustica United with Acustica, 2002, vol. 88, pp. 433-442.
Jeffress, Lloyd A. et al. "A Place Theory of Sound Localization," Journal of Comparative and Physiological Psychology, 1948, vol. 41, p. 35-39.
Jeong, Hyuk et al., "Implementation of a New Algorithm Using the STFT with Variable Frequency Resolution for the Time-Frequency Auditory Model", J. Audio Eng. Soc., Apr. 1999, vol. 47, No. 4., pp. 240-251.
Kates, James M. "A Time-Domain Digital Cochlear Model", IEEE Transactions on Signal Processing, Dec. 1991, vol. 39, No. 12, pp. 2573-2592.
Lazzaro, John et al., "A Silicon Model of Auditory Localization," Neural Computation Spring 1989, vol. 1, pp. 47-57, Massachusetts Institute of Technology.
Lippmann, Richard P. "Speech Recognition by Machines and Humans", Speech Communication, Jul. 1997, vol. 22, No. 1, pp. 1-15.
Liu, Chen et al. "A Two-Microphone Dual Delay-Line Approach for Extraction of a Speech Sound in the Presence of Multiple Interferers", Journal of the Acoustical Society of America, vol. 110, No. 6, Dec. 2001, pp. 3218-3231.
Martin, Rainer et al. "Combined Acoustic Echo Cancellation, Dereverberation and Noise Reduction: A two Microphone Approach", Annales des Telecommunications/Annals of Telecommunications. vol. 49, No. 7-8, Jul.-Aug. 1994, pp. 429-438.
Martin, Rainer "Spectral Subtraction Based on Minimum Statistics", in Proceedings Europe. Signal Processing Conf., 1994, pp. 1182-1185.
Mitra, Sanjit K. Digital Signal Processing: a Computer-based Approach. 2nd Ed. 2001. pp. 131-133.
Mizumachi, Mitsunori et al. "Noise Reduction by Paired-Microphones Using Spectral Subtraction", 1998 IEEE International Conference on Acoustics, Speech and Signal Processing, May 12-15. pp. 1001-1004.
Moonen, Marc et al. "Multi-Microphone Signal Enhancement Techniques for Noise Suppression and Dereverbration," http://www.esat.kuleuven.ac.be/sista/yearreport97//node37.html, accessed on Apr. 21, 1998.
Watts, Lloyd Narrative of Prior Disclosure of Audio Display on Feb. 15, 2000 and May 31, 2000.
Cosi, Piero et al. (1996), "Lyon's Auditory Model Inversion: a Tool for Sound Separation and Speech Enhancement," Proceedings of ESCA Workshop on 'The Auditory Basis of Speech Perception,' Keele University, Keele (UK), Jul. 15-19, 1996, pp. 194-197.
Parra, Lucas et al. "Convolutive Blind Separation of Non-Stationary Sources", IEEE Transactions on Speech and Audio Processing. vol. 8, No. 3, May 2008, pp. 320-327.
Rabiner, Lawrence R. et al. "Digital Processing of Speech Signals", (Prentice-Hall Series in Signal Processing). Upper Saddle River, NJ: Prentice Hall, 1978.
Weiss, Ron et al., "Estimating Single-Channel Source Separation Masks: Revelance Vector Machine Classifiers vs. Pitch-Based Masking", Workshop on Statistical and Perceptual Audio Processing, 2006.
Schimmel, Steven et al., "Coherent Envelope Detection for Modulation Filtering of Speech," 2005 IEEE International Conference on Acoustics, Speech, and Signal Processing, vol. 1, No. 7, pp. 221-224.
Slaney, Malcom, "Lyon's Cochlear Model", Advanced Technology Group, Apple Technical Report #13, Apple Computer, Inc., 1988, pp. 1-79.
Slaney, Malcom, et al. "Auditory Model Inversion for Sound Separation," 1994 IEEE International Conference on Acoustics, Speech and Signal Processing, Apr. 19-22, vol. 2, pp. 77-80.
Slaney, Malcom. "An Introduction to Auditory Model Inversion", Interval Technical Report IRC 1994-014, http://coweb.ecn.purdue.edu/~maclom/interval/1994-014/, Sep. 1994, accessed on Jul. 6, 2010.
Solbach, Ludger "An Architecture for Robust Partial Tracking and Onset Localization in Single Channel Audio Signal Mixes", Technical University Hamburg-Harburg, 1998.
Stahl, V. et al., "Quantile Based Noise Estimation for Spectral Subtraction and Wiener Filtering," 2000 IEEE International Conference on Acoustics, Speech, and Signal Processing, Jun. 5-9, vol. 3, pp. 1875-1878.
Syntrillium Software Corporation, "Cool Edit User's Manual", 1996, pp. 1-74.
Tashev, Ivan et al. "Microphone Array for Headset with Spatial Noise Suppressor", http://research.microsoft.com/users/ivantash/Documents/Tashev_MAforHeadset_HSCMA_05.pdf. (4 pages).
Tchorz, Jurgen et al., "SNR Estimation Based on Amplitude Modulation Analysis with Applications to Noise Suppression", IEEE Transactions on Speech and Audio Processing, vol. 11, No. 3, May 2003, pp. 184-192.
Valin, Jean-Marc et al. "Enhanced Robot Audition Based on Microphone Array Source Separation with Post-Filter", Proceedings of 2004 IEEE/RSJ International Conference on Intelligent Robots and Systems, Sep. 28-Oct. 2, 2004, Sendai, Japan. pp. 2123-2128.
Watts, Lloyd, "Robust Hearing Systems for Intelligent Machines," Applied Neurosystems Corporation, 2001, pp. 1-5.
Widrow, B. et al., "Adaptive Antenna Systems," Proceedings of the IEEE, vol. 55, No. 12, pp. 2143-2159, Dec. 1967.
Yoo, Heejong et al., "Continuous-Time Audio Noise Suppression and Real-Time Implementation", 2002 IEEE International Conference on Acoustics, Speech, and Signal Processing, May 13-17, pp. IV3980-IV3983.
International Search Report dated Jun. 8, 2001 in Application No. PCT/US01/08372.
International Search Report dated Apr. 3, 2003 in Application No. PCT/US02/36946.
International Search Report dated May 29, 2003 in Application No. PCT/US03/04124.
International Search Report and Written Opinion dated Oct. 19, 2007 in Application No. PCT/US07/00463.
International Search Report and Written Opinion dated Apr. 9, 2008 in Application No. PCT/US07/21654.
International Search Report and Written Opinion dated Sep. 16, 2008 in Application No. PCT/US07/12628.
International Search Report and Written Opinion dated Oct. 1, 2008 in Application No. PCT/US08/08249.
International Search Report and Written Opinion dated May 11, 2009 in Application No. PCT/US09/01667.
International Search Report and Written Opinion dated Aug. 27, 2009 in Application No. PCT/US09/03813.
International Search Report and Written Opinion dated May 20, 2010 in Application No. PCT/US09/06754.
Fast Cochlea Transform, US Trademark Reg. No. 2,875,755 (Aug. 17, 2004).

(56) References Cited

OTHER PUBLICATIONS

Dahl, Mattias et al., "Acoustic Echo and Noise Cancelling Using Microphone Arrays", International Symposium on Signal Processing and its Applications, ISSPA, Gold coast, Australia, Aug. 25-30, 1996, pp. 379-382.

Demol, M. et al. "Efficient Non-Uniform Time-Scaling of Speech With WSOLA for CALL Applications", Proceedings of InSTIL/ICALL2004—NLP and Speech Technologies in Advanced Language Learning Systems—Venice Jun. 17-19, 2004.

Laroche, Jean. "Time and Pitch Scale Modification of Audio Signals", in "Applications of Digital Signal Processing to Audio and Acoustics", The Kluwer International Series in Engineering and Computer Science, vol. 437, pp. 279-309, 2002.

Moulines, Eric et al., "Non-Parametric Techniques for Pitch-Scale and Time-Scale Modification of Speech", Speech Communication, vol. 16, pp. 175-205, 1995.

Verhelst, Werner, "Overlap-Add Methods for Time-Scaling of Speech", Speech Communication vol. 30, pp. 207-221, 2000.

* cited by examiner

SYSTEM AND METHOD FOR ADAPTIVE INTELLIGENT NOISE SUPPRESSION

CROSS-REFERENCE TO RELATED APPLICATION

The present application is a continuation of U.S. patent application Ser. No. 11/825,563, filed Jul. 6, 2007 and entitled "System and Method for Adaptive Intelligent Noise Suppression," now U.S. Pat. No. 8,744,844, issued Jun. 3, 2014, which is herein incorporated by reference. The present application is related to U.S. patent application Ser. No. 11/343,524, filed Jan. 30, 2006 and entitled "System and Method for Utilizing Inter-Microphone Level Differences for Speech Enhancement," now U.S. Pat. No. 8,345,890, issued Jan. 1, 2013, and U.S. patent application Ser. No. 11/699,732, filed Jan. 29, 2007 and entitled "System And Method For Utilizing Omni-Directional Microphones For Speech Enhancement," now U.S. Pat. No. 8,194,880, issued Jun. 5, 2012, both of which are herein incorporated by reference.

BACKGROUND OF THE INVENTION

1. Field of Invention

The present invention relates generally to audio processing and more particularly to adaptive noise suppression of an audio signal.

2. Description of Related Art

Currently, there are many methods for reducing background noise in an adverse audio environment. One such method is to use a constant noise suppression system. The constant noise suppression system will always provide an output noise that is a fixed amount lower than the input noise. Typically, the fixed noise suppression is in the range of 12-13 decibels (dB). The noise suppression is fixed to this conservative level in order to avoid producing speech distortion, which will be apparent with higher noise suppression.

In order to provide higher noise suppression, dynamic noise suppression systems based on signal-to-noise ratios (SNR) have been utilized. This SNR may then be used to determine a suppression value. Unfortunately, SNR, by itself, is not a very good predictor of speech distortion due to existence of different noise types in the audio environment. SNR is a ratio of how much louder speech is than noise. However, speech may be a non-stationary signal which may constantly change and contain pauses. Typically, speech energy, over a period of time, will comprise a word, a pause, a word, a pause, and so forth. Additionally, stationary and dynamic noises may be present in the audio environment. The SNR averages all of these stationary and non-stationary speech and noise. There is no consideration as to the statistics of the noise signal; only what the overall level of noise is.

In some prior art systems, an enhancement filter may be derived based on an estimate of a noise spectrum. One common enhancement filter is the Wiener filter. Disadvantageously, the enhancement filter is typically configured to minimize certain mathematical error quantities, without taking into account a user's perception. As a result, a certain amount of speech degradation is introduced as a side effect of the noise suppression. This speech degradation will become more severe as the noise level rises and more noise suppression is applied. That is, as the SNR gets lower, lower gain is applied resulting in more noise suppression. This introduces more speech loss distortion and speech degradation.

Therefore, it is desirable to be able to provide adaptive noise suppression that will minimize or eliminate speech loss distortion and degradation.

SUMMARY OF THE INVENTION

Embodiments of the present invention overcome or substantially alleviate prior problems associated with noise suppression and speech enhancement. In exemplary embodiments, a primary acoustic signal is received by an acoustic sensor. The primary acoustic signal is then separated into frequency bands for analysis. Subsequently, an energy module computes energy/power estimates during an interval of time for each frequency band (i.e., power estimates). A power spectrum (i.e., power estimates for all frequency bands of the acoustic signal) may be used by a noise estimate module to determine a noise estimate for each frequency band and an overall noise spectrum for the acoustic signal.

An adaptive intelligent suppression generator uses the noise spectrum and a power spectrum of the primary acoustic signal to estimate speech loss distortion (SLD). The SLD estimate is used to derive control signals which adaptively adjust an enhancement filter. The enhancement filter is utilized to generate a plurality of gains or gain masks, which may be applied to the primary acoustic signal to generate a noise suppressed signal.

In accordance with some embodiments, two acoustic sensors may be utilized: one sensor to capture the primary acoustic signal and a second sensor to capture a secondary acoustic signal. The two acoustic signals may then be used to derive an inter-level difference (ILD). The ILD allows for more accurate determination of the estimated SLD.

In some embodiments, a comfort noise generator may generate comfort noise to apply to the noise suppressed signal. The comfort noise may be set to a level that is just above audibility.

DESCRIPTION OF EXEMPLARY EMBODIMENTS

The present invention provides exemplary systems and methods for adaptive intelligent suppression of noise in an audio signal. Embodiments attempt to balance noise suppression with minimal or no speech degradation (i.e., speech loss distortion). In exemplary embodiments, power estimates of speech and noise are determined in order to predict an amount of speech loss distortion (SLD). A control signal is derived from this SLD estimate, which is then used to adaptively modify an enhancement filter to minimize or prevent SLD. As a result, a large amount of noise suppression may be applied when possible, and the noise suppression may be reduced when conditions do not allow for the large amount of noise suppression (e.g., high SLD). Additionally, exemplary embodiments adaptively apply only enough noise suppression to render the noise inaudible when the noise level is low. In some cases, this may result in no noise suppression.

Embodiments of the present invention may be practiced on any audio device that is configured to receive sound such as, but not limited to, cellular phones, phone handsets, headsets, and conferencing systems. Advantageously, exemplary embodiments are configured to provide improved noise suppression while minimizing speech degradation. While some embodiments of the present invention will be described in reference to operation on a cellular phone, the present invention may be practiced on any audio device.

Figure 1:
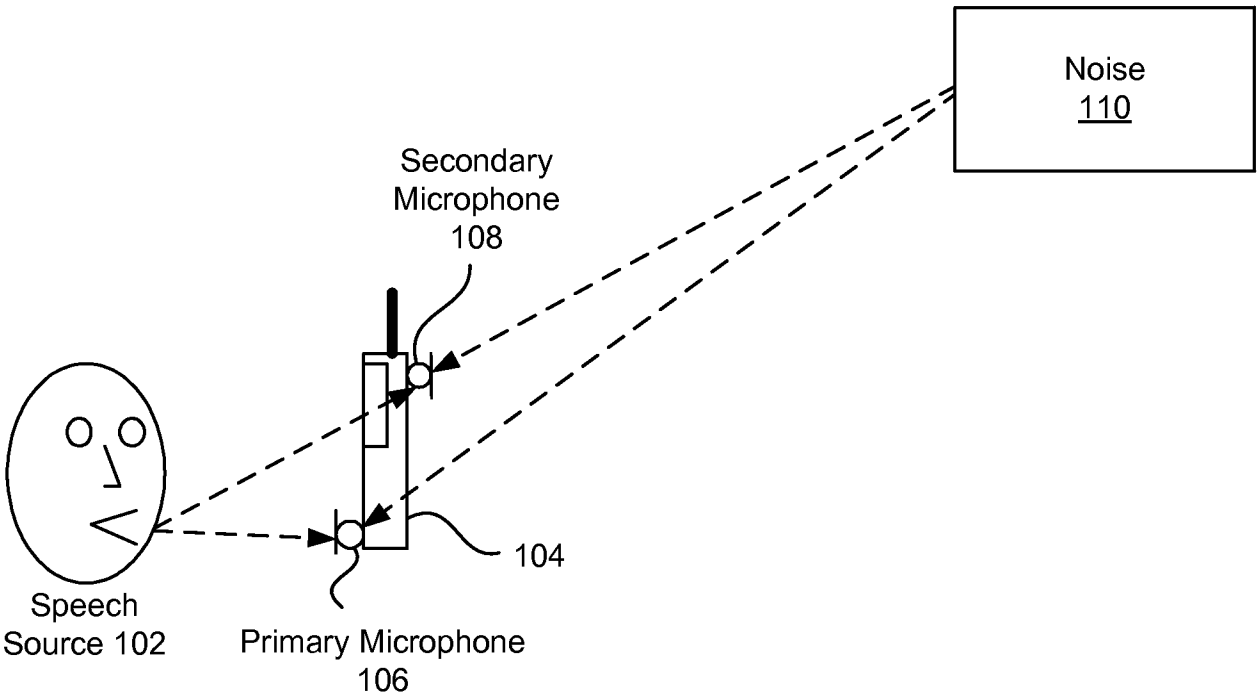
FIG. 1 is an environment in which embodiments of the present invention may be practiced.

Referring to FIG. 1, an environment in which embodiments of the present invention may be practiced is shown. A user acts as a speech (audio) source 102 to an audio device 104. The exemplary audio device 104 comprises two microphones: a primary microphone 106 relative to the audio source 102 and a secondary microphone 108 located a distance away from the primary microphone 106. In some embodiments, the microphones 106 and 108 comprise omnidirectional microphones.

While the microphones 106 and 108 receive sound (i.e., acoustic signals) from the audio source 102, the microphones 106 and 108 also pick up noise 110. Although the noise 110 is shown coming from a single location in FIG. 1, the noise 110 may comprise any sounds from one or more locations different than the audio source 102, and may include reverberations and echoes. The noise 110 may be stationary, non-stationary, and/or a combination of both stationary and non-stationary noise.

Some embodiments of the present invention utilize level differences (e.g., energy differences) between the acoustic signals received by the two microphones 106 and 108. Because the primary microphone 106 is much closer to the audio source 102 than the secondary microphone 108, the intensity level is higher for the primary microphone 106 resulting in a larger energy level during a speech/voice segment, for example.

The level difference may then be used to discriminate speech and noise in the time-frequency domain. Further embodiments may use a combination of energy level differences and time delays to discriminate speech. Based on binaural cue decoding, speech signal extraction or speech enhancement may be performed.

Figure 2:
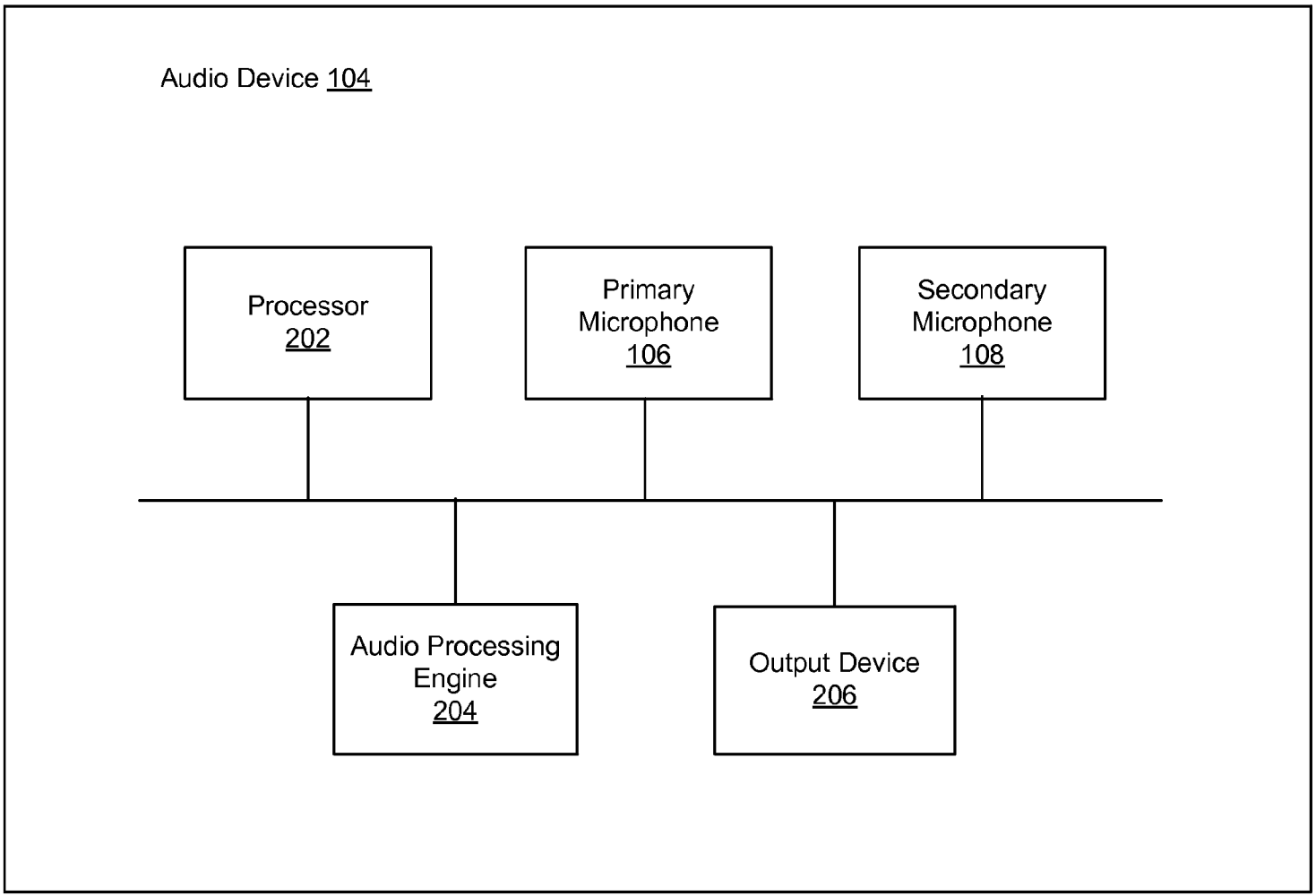
FIG. 2 is a block diagram of an exemplary audio device implementing embodiments of the present invention.

Referring now to FIG. 2, the exemplary audio device 104 is shown in more detail. In exemplary embodiments, the audio device 104 is an audio receiving device that comprises a processor 202, the primary microphone 106, the secondary microphone 108, an audio processing engine 204, and an output device 206. The audio device 104 may comprise further components necessary for audio device 104 operations. The audio processing engine 204 will be discussed in more details in connection with FIG. 3.

As previously discussed, the primary and secondary microphones 106 and 108, respectively, are spaced a distance apart in order to allow for an energy level differences between them. Upon reception by the microphones 106 and 108, the acoustic signals are converted into electric signals (i.e., a primary electric signal and a secondary electric signal). The electric signals may themselves be converted by an analog-to-digital converter (not shown) into digital signals for processing in accordance with some embodiments. In order to differentiate the acoustic signals, the acoustic signal received by the primary microphone 106 is herein referred to as the primary acoustic signal, while the acoustic signal received by the secondary microphone 108 is herein referred to as the secondary acoustic signal. It should be noted that embodiments of the present invention may be practiced utilizing only a single microphone (i.e., the primary microphone 106).

The output device 206 is any device which provides an audio output to the user. For example, the output device 206 may comprise an earpiece of a headset or handset, or a speaker on a conferencing device.

Figure 3:
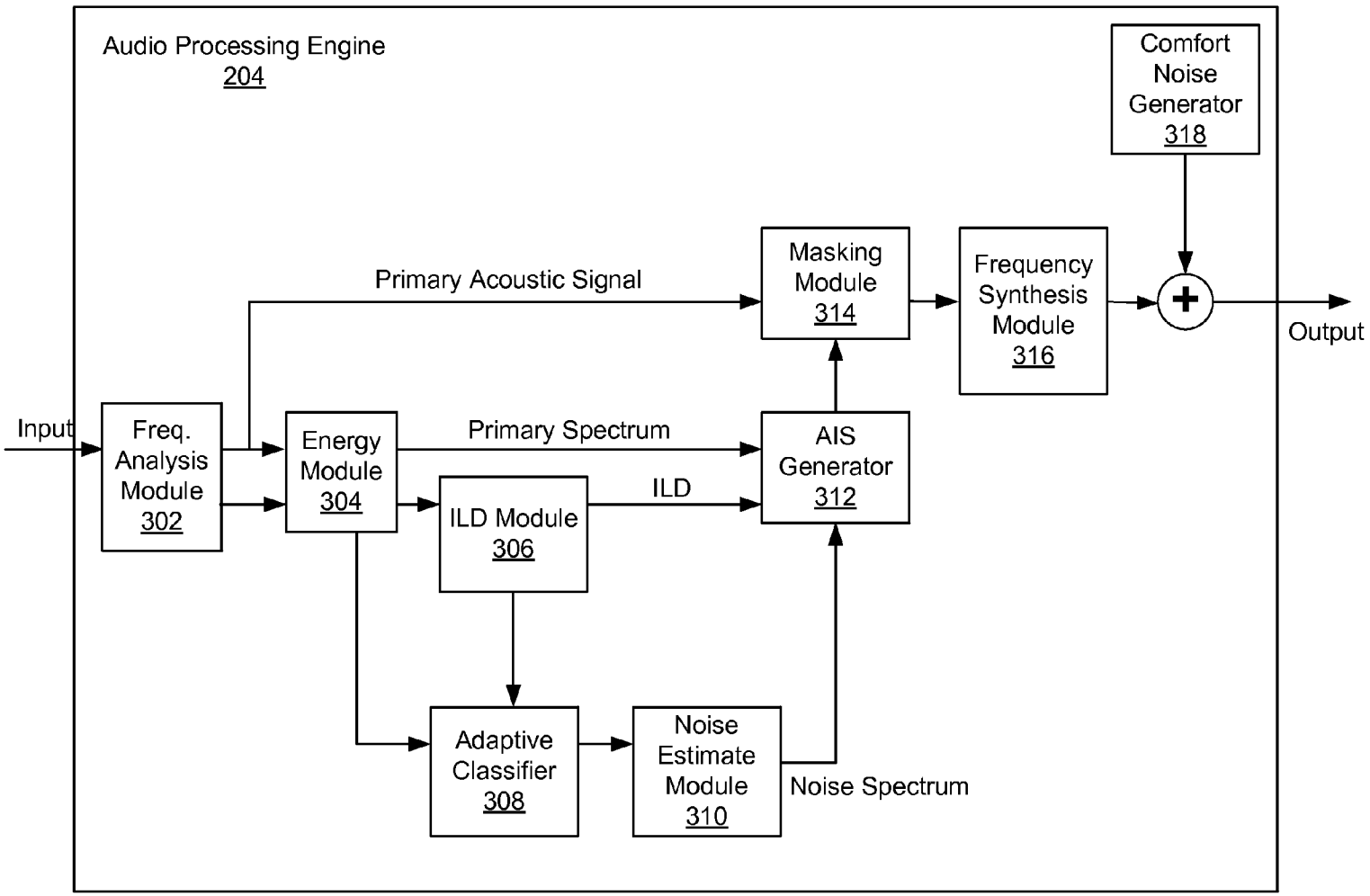
FIG. 3 is a block diagram of an exemplary audio processing engine.

FIG. 3 is a detailed block diagram of the exemplary audio processing engine 204, according to one embodiment of the present invention. In exemplary embodiments, the audio processing engine 204 is embodied within a memory device. In operation, the acoustic signals received from the primary and secondary microphones 106 and 108 are converted to electric signals and processed through a frequency analysis module 302. In one embodiment, the frequency analysis module 302 takes the acoustic signals and mimics the frequency analysis of the cochlea (i.e., cochlear domain) simulated by a filter bank. In one example, the frequency analysis module 302 separates the acoustic signals into frequency bands. Alternatively, other filters such as short-time Fourier transform (STFT), sub-band filter banks, modulated complex lapped transforms, cochlear models, wavelets, etc., can be used for the frequency analysis and synthesis. Because most sounds (e.g., acoustic signals) are complex and comprise more than one frequency, a sub-band analysis on the acoustic signal determines what individual frequencies are present in the acoustic signal during a frame (e.g., a predetermined period of time). According to one embodiment, the frame is 8 ms long.

According to an exemplary embodiment of the present invention, an adaptive intelligent suppression (AIS) generator 312 derives time and frequency varying gains or gain masks used to suppress noise and enhance speech. In order to derive the gain masks, however, specific inputs are needed for the AIS generator 312. These inputs comprise a power spectral density of noise (i.e., noise spectrum), a power spectral density of the primary acoustic signal (i.e., primary spectrum), and an inter-microphone level difference (ILD).

As such, the signals are forwarded to an energy module 304 which computes energy/power estimates during an interval of time for each frequency band (i.e., power estimates) of an acoustic signal. As a result, a primary spectrum (i.e., the power spectral density of the primary acoustic signal) across all frequency bands may be determined by the energy module 304. This primary spectrum may be supplied to an adaptive intelligent suppression (AIS) generator 312 and an ILD module 306 (discussed further herein). Similarly, the energy module 304 determines a secondary spectrum (i.e., the power spectral density of the secondary acoustic signal) across all frequency bands to be supplied to the ILD module 306.

In embodiments utilizing two microphones, power spectrums of both the primary and secondary acoustic signals may be determined. The primary spectrum comprises the power spectrum from the primary acoustic signal (from the primary microphone 106), which contains both speech and noise. In exemplary embodiments, the primary acoustic signal is the signal which will be filtered in the AIS generator 312. Thus, the primary spectrum is forwarded to the AIS generator 312. More details regarding the calculation of power estimates and power spectrums can be found in co-pending U.S. patent application Ser. No. 11/343,524 and co-pending U.S. patent application Ser. No. 11/699,732, which are incorporated by reference.

In two microphone embodiments, the power spectrums are also used by an inter-microphone level difference (ILD) module 306 to determine a time and frequency varying ILD. Because the primary and secondary microphones 106 and 108 may be oriented in a particular way, certain level differences may occur when speech is active and other level differences may occur when noise is active. The ILD is then forwarded to an adaptive classifier 308 and the AIS generator 312. More details regarding the calculation of ILD may be can be found in co-pending U.S. patent application Ser. No. 11/343,524 and co-pending U.S. patent application Ser. No. 11/699,732.

The exemplary adaptive classifier 308 is configured to differentiate noise and distractors (e.g., sources with a negative ILD) from speech in the acoustic signal(s) for each frequency band in each frame. The adaptive classifier 308 is adaptive because features (e.g., speech, noise, and distractors) change and are dependent on acoustic conditions in the environment. For example, an ILD that indicates speech in one situation may indicate noise in another situation. Therefore, the adaptive classifier 308 adjusts classification boundaries based on the ILD.

According to exemplary embodiments, the adaptive classifier 308 differentiates noise and distractors from speech and provides the results to the noise estimate module 310 in order to derive the noise estimate. Initially, the adaptive classifier 308 determines a maximum energy between channels at each frequency. Local ILDs for each frequency are also determined. A global ILD may be calculated by applying the energy to the local ILDs. Based on the newly calculated global ILD, a running average global ILD and/or a running mean and variance (i.e., global cluster) for ILD observations may be updated. Frame types may then be classified based on a position of the global ILD with respect to the global cluster. The frame types may comprise source, background, and distractors.

Once the frame types are determined, the adaptive classifier 308 may update the global average running mean and variance (i.e., cluster) for the source, background, and distractors. In one example, if the frame is classified as source, background, or distractor, the corresponding global cluster is considered active and is moved toward the global ILD. The global source, background, and distractor global clusters that do not match the frame type are considered inactive. Source and distractor global clusters that remain inactive for a predetermined period of time may move toward the background global cluster. If the background global cluster remains inactive for a predetermined period of time, the background global cluster moves to the global average.

Once the frame types are determined, the adaptive classifier 308 may also update the local average running mean and variance (i.e., cluster) for the source, background, and distractors. The process of updating the local active and inactive clusters is similar to the process of updating the global active and inactive clusters.

Based on the position of the source and background clusters, points in the energy spectrum are classified as source or noise; this result is passed to the noise estimate module 310.

In an alternative embodiment, an example of an adaptive classifier 308 comprises one that tracks a minimum ILD in each frequency band using a minimum statistics estimator. The classification thresholds may be placed a fixed distance (e.g., 3 dB) above the minimum ILD in each band. Alternatively, the thresholds may be placed a variable distance above the minimum ILD in each band, depending on the recently observed range of ILD values observed in each band. For example, if the observed range of ILDs is beyond 6 dB, a threshold may be place such that it is midway between the minimum and maximum ILDs observed in each band over a certain specified period of time (e.g., 2 seconds).

In exemplary embodiments, the noise estimate is based only on the acoustic signal from the primary microphone 106. The exemplary noise estimate module 310 is a component which can be approximated mathematically by $$N(t,\omega)=\lambda_I(t,\omega)E_1(t,\omega)+(1-\lambda_I(t,\omega))\min[N(t-1,\omega),E_1(t,\omega)]$$

according to one embodiment of the present invention. As shown, the noise estimate in this embodiment is based on minimum statistics of a current energy estimate of the primary acoustic signal, $E_1(t,\omega)$ and a noise estimate of a previous time frame, $N(t-1,\omega)$. As a result, the noise estimation is performed efficiently and with low latency.

$\lambda_I(t,\omega)$ in the above equation is derived from the ILD approximated by the ILD module 306, as $$\lambda_I(t,\omega)=\begin{cases}\approx 0 & \text{if } ILD(t,\omega)<\text{threshold}\\ \approx 1 & \text{if } ILD(t,\omega)>\text{threshold}\end{cases}$$

That is, when the primary microphone 106 is smaller than a threshold value (e.g., threshold=0.5) above which speech is expected to be, $\lambda_I$ is small, and thus the noise estimate module 310 follows the noise closely. When ILD starts to rise (e.g., because speech is present within the large ILD region), $\lambda_I$ increases. As a result, the noise estimate module 310 slows down the noise estimation process and the speech energy does not contribute significantly to the final noise estimate. Therefore, exemplary embodiments of the present invention may use a combination of minimum statistics and voice activity detection to determine the noise estimate. A noise spectrum (i.e., noise estimates for all frequency bands of an acoustic signal) is then forwarded to the AIS generator 312.

Speech loss distortion (SLD) is based on both the estimate of a speech level and the noise spectrum. The AIS generator 312 receives both the speech and noise of the primary spectrum from the energy module 304 as well as the noise spectrum from the noise estimate module 310. Based on these inputs and an optional ILD from the ILD module 306, a speech spectrum may be inferred; that is the noise estimates of the noise spectrum may be subtracted out from the power estimates of the primary spectrum. Subsequently, the AIS generator 312 may determine gain masks to apply to the primary acoustic signal. The AIS generator 312 will be discussed in more detail in connection with FIG. 4 below.

The SLD is a time varying estimate. In exemplary embodiments, the system may utilize statistics from a predetermined, settable amount of time (e.g., two seconds) of the audio signal. If noise or speech changes over the next few seconds, the system may adjust accordingly.

In exemplary embodiments, the gain mask output from the AIS generator 312, which is time and frequency dependent, will maximize noise suppression while constraining the SLD. Accordingly, each gain mask is applied to an associated frequency band of the primary acoustic signal in a masking module 314.

Next, the masked frequency bands are converted back into time domain from the cochlea domain. The conversion may comprise taking the masked frequency bands and adding together phase shifted signals of the cochlea channels in a frequency synthesis module 316. Once conversion is completed, the synthesized acoustic signal may be output to the user.

In some embodiments, comfort noise generated by a comfort noise generator 318 may be added to the signal prior to output to the user. Comfort noise comprises a uniform, constant noise that is not usually discernable to a listener (e.g., pink noise). This comfort noise may be added to the acoustic signal to enforce a threshold of audibility and to mask low-level non-stationary output noise components. In some embodiments, the comfort noise level may be chosen to be just above a threshold of audibility and may be settable by a user. In exemplary embodiments, the AIS generator 312 may know the level of the comfort noise in order to generate gain masks that will suppress the noise to a level below the comfort noise.

It should be noted that the system architecture of the audio processing engine 204 of FIG. 3 is exemplary. Alternative embodiments may comprise more components, less components, or equivalent components and still be within the scope of embodiments of the present invention. Various modules of the audio processing engine 204 may be combined into a single module. For example, the functionalities of the frequency analysis module 302 and energy module 304 may be combined into a single module. As a further example, the functions of the ILD module 306 may be combined with the functions of the energy module 304 alone, or in combination with the frequency analysis module 302.

Figure 4:
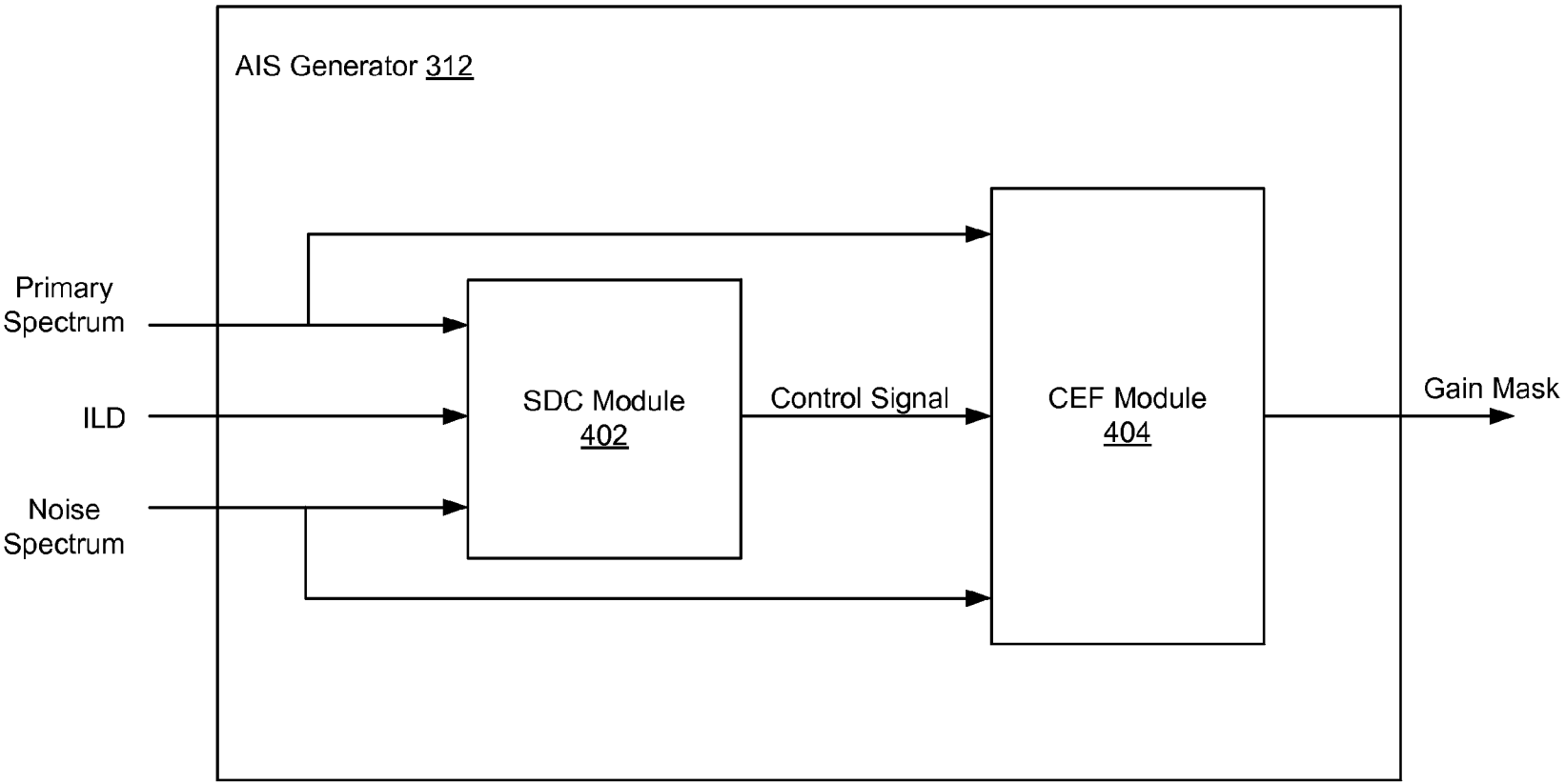
FIG. 4 is a block diagram of an exemplary adaptive intelligent suppression generator.

Referring now to FIG. 4, the exemplary AIS generator 312 is shown in more detail. The exemplary AIS generator 312 may comprise a speech distortion control (SDC) module 402 and a compute enhancement filter (CEF) module 404. Based on the primary spectrum, ILD, and noise spectrum, gain masks (e.g., time varying gains for each frequency band) may be determined by the AIS generator 312.

The exemplary SDC module 402 is configured to estimate an amount of speech loss distortion (SLD) and to derive associated control signals used to adjust behavior of the CEF module 404. Essentially, the SDC module 402 collects and analyzes statistics for a plurality of different frequency bands. The SLD estimate is a function of the statistics at all the different frequency bands. It should be noted that some frequency bands may be more important than other frequency bands. In one example, certain sounds such as speech are associated with a limited frequency band. In various embodiments, the SDC module 402 may apply weighting factors when analyzing the statistics for a plurality of different frequency bands to better adjust the behavior of the CEF module 404 to produce a more effective gain mask.

In exemplary embodiments, the SDC module 402 may compute an internal estimate of long-term speech levels (SL), based on the primary spectrum and ILD at each point in time, and compare the internal estimate with the noise spectrum estimate to estimate an amount of possible signal loss distortion. According to one embodiment, a current SL may be determined by first updating a decay factor. In one example, the decay factor (in dB) starts at 0 when the SL estimate is updated, and increases linearly with time (e.g., 1 dB per second) until the SL estimate is updated again (at which time it is reset to 0). If the ILD is above some threshold, T, and if the primary spectrum is higher than a current SL estimate minus the decay factor, the SL estimate is updated and set to the primary spectrum (in dB units). If these conditions are not met, the SL estimate is held at its previously estimated value. In some embodiments, the SL estimate may be limited to a lower and upper bound where the speech level is expected to normally reside.

Once the SL estimate is determined, the SLD estimate may be calculated. Initially, the noise spectrum in a frame may be subtracted (in dB units) from the SL estimate, and the $M^{th}$ lowest value of the result calculated. The result is then placed into a circular buffer where the oldest value in the buffer is discarded. The $N^{th}$ lowest value of the SLD over a predetermined time in the buffer is then determined. The result is then used to set the SDC module 402 output under constraints on how quickly the output can change (e.g., slew rate). A resulting output, x, may be transformed to a power domain according to $\lambda=10^{X/10}$. The result $\lambda$ (i.e., the control signal) is then used by the CEF module 404.

The exemplary CEF module 404 generates the gain masks based on the speech spectrum and the noise spectrum, which abide by constraints. These constraints may be driven by the SDC output (i.e., control signals from the SDC module 402) and knowledge of a noise floor and extent to which components of the audio output will be audible. As a result, the gain mask attempts to minimize noise audibility with a maximum SLD constraint and a minimum background noise continuity constraint.

In exemplary embodiments, computation of the gain mask is based on a Wiener filter approach. The standard Wiener filter equation is $$G(f) = \frac{Ps(f)}{Ps(f) + Pn(f)},$$

where $P_s$ is a speech signal spectrum, $P_n$ is the noise spectrum (provided by the noise estimate module 310), and f is the frequency. In exemplary embodiments, $P_s$ may be derived by subtracting $P_n$ from the primary spectrum. In some embodiments, the result may be temporally smoothed using a low pass filter.

A modified version of the Wiener filter (i.e., the enhancement filter) that reduces the signal loss distortion is represented by $$G(f) = \frac{Ps(f)}{Ps(f) + \gamma \cdot Pn(f)},$$

where $\gamma$ is between zero and one. The lower $\gamma$ is, the more the signal loss distortion is reduced. In exemplary embodiments, the signal loss distortion may only need to be reduced in situations where the standard Wiener filter will cause the signal loss distortion to be high. Thus, $\gamma$ is adaptive. This factor, $\gamma$, may be obtained by mapping $\lambda$, the output of the SDC module 402, onto an interval between zero and one. This might be accomplished using an equation such as $\gamma=\min(1, \lambda/\lambda_0)$ In this case, $\lambda_0$ is a parameter that corresponds to the minimum allowable SLD.

The modified enhancement filter can increase perceptibility of noise modulation, where the output noise is perceived to increase when speech is active. As a result, it may be necessary to place a limit on the output noise level when speech is not active. This may be accomplished by placing a lower limit on the gain mask, Glb. In exemplary embodiments, Glb may be dependent on $\lambda$. As a result, the filter equation may be represented as $$G(f) = \max\left(Glb(\lambda), \frac{Ps(f)}{Ps(f) + \gamma \cdot Pn(f)}\right),$$

where Glb generally increases as $\lambda$ decreases. This may be achieved through the equation $Glb=\min(1, \sqrt{\lambda_1/\lambda})$. In this case, $\lambda_1$ is a parameter that controls an amount of noise continuity for a given value of $\lambda$. The higher $\lambda_1$, the more continuity. As such, the CEF module 404 essentially replaces the Wiener filter of prior embodiments.

Figure 5:
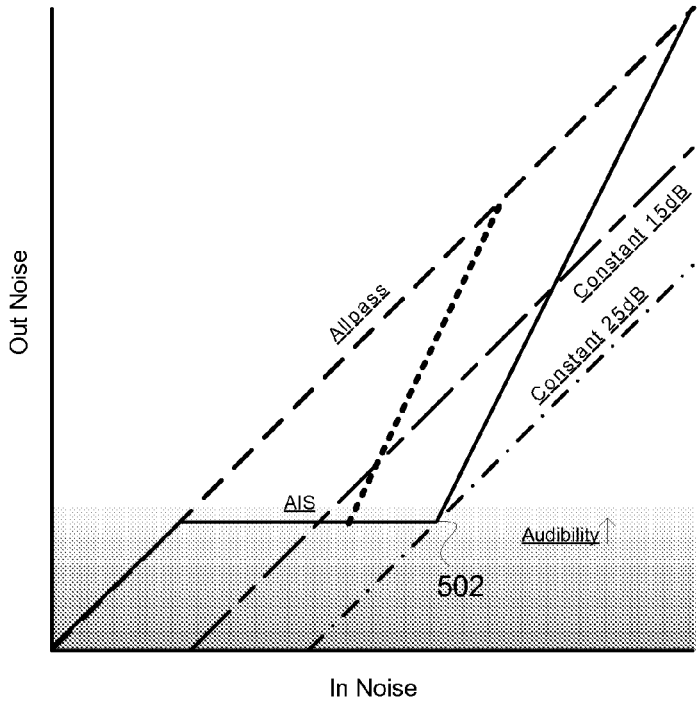
FIG. 5 is a diagram illustrating adaptive intelligent noise suppression compared to constant noise suppression systems.
Figure 5:
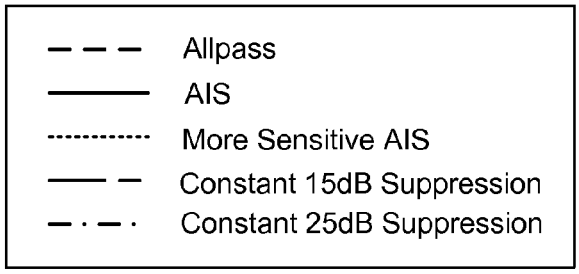

Referring now to FIG. 5, a diagram illustrating adaptive intelligent (noise) suppression (AIS) compared to constant noise suppression systems is illustrated. As shown, embodiments of the present invention attempt to keep the output noise near a threshold of audibility. Thus, if the noise is below a level of audibility, no noise suppression may be applied by embodiments of the present invention. However, when the noise level becomes audible, embodiments of the present invention will attempt to keep the output noise to a level just under the level of audibility.

Embodiments of the present invention may at different times suppress more and at other times suppress less then a constant suppression system. Additionally, embodiments may adjust to be more or less sensitive to speech distortion. For example, an AIS setting that is more sensitive to speech distortion and thus provide conservative suppression is shown in FIG. 5 (i.e., more sensitive AIS). However, the perception is essentially identical when the output noise is kept below the threshold of audibility.

In exemplary embodiments, the output noise is kept constant until the noise level becomes too high. Once the noise level rises to a level that is too high, the gain masks are adjusted by the AIS generator 312 to reduce the amount of suppression in order to avoid SLD. In exemplary embodiments, the present invention may be adjusted to be more or less sensitive to SLD by a user.

As discussed above, the threshold of audibility may be enforced or controlled by the addition of comfort noise. The presence of comfort noise may ensure that output noise components at a level below that of the comfort noise level are not perceivable to a listener.

Generally, speech distortion may occur for SNRs lower than 15 dB. In exemplary embodiments, the amount of noise suppression below 15 dB may be reduced. The maximum amount of noise suppression will occur at a knee 502 on the in noise/out noise curve. However, the actual SNR at which the knee 502 occurs is signal dependent, since embodiments of the present invention utilizes an estimate of signal loss distortion (SLD) and not SNR. For a given SNR for different types of audio sources, different amounts of speech degradation may occur. For example, narrowband and non-stationary noise signals may cause less signal loss distortion than broadband and stationary noise. The knee 502 may then occur at a lower SNR for the narrowband and non-stationary noise signals. For example, if the knee 502 occurs at 5 dB SNR, for a pink noise source, it may occur at 0 dB for a noise source comprising speech.

In some embodiments, noise gating may occur at very high noise levels. If there is a pause in speech, embodiments of the present invention may be providing a lot of noise suppression. When the speech comes on, the system may quickly back off on the noise suppression, but some noise can be heard as the speech comes on. As a result, noise suppression needs to be backed off a certain amount so that some continuity exists which the system can use to group noise components together. So rather than having noise coming on when the speech becomes present, some background noise may be preserved (i.e., reduce noise suppression to an amount necessary to reduce the noise gating effect). Then, it becomes less of an annoying effect and not really noticeable when speech is present.

Figure 6:
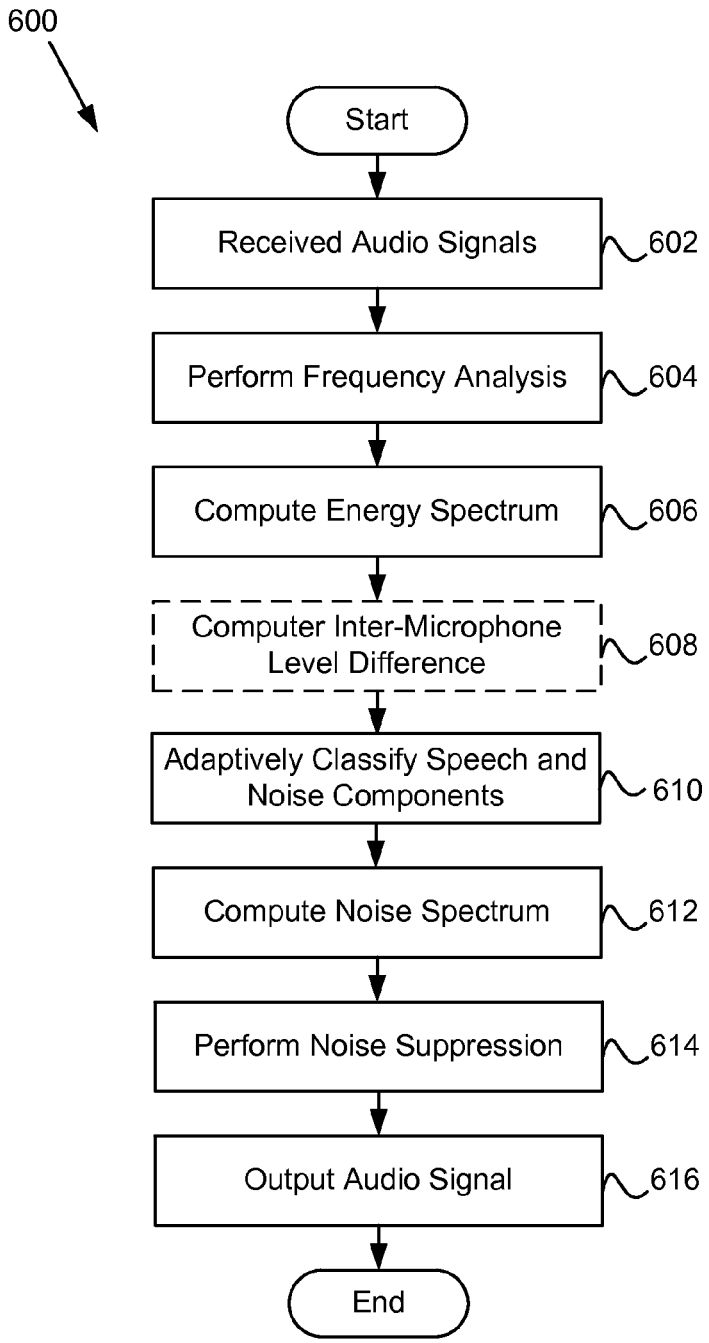
FIG. 6 is a flowchart of an exemplary method for noise suppression using an adaptive intelligent suppression system.

Referring now to FIG. 6, an exemplary flowchart 600 of an exemplary method for noise suppression utilizing an adaptive intelligent suppression (AIS) system is shown. In step 602, audio signals are received by a primary microphone 106 and an optional secondary microphone 108. In exemplary embodiments, the acoustic signals are converted to digital format for processing.

Frequency analysis is then performed on the acoustic signals by the frequency analysis module 302 in step 604. According to one embodiment, the frequency analysis module 302 utilizes a filter bank to determine individual frequency bands present in the acoustic signal(s).

In step 606, energy spectrums for acoustic signals received at both the primary and secondary microphones 106 and 108 are computed. In one embodiment, the energy estimate of each frequency band is determined by the energy module 304. In exemplary embodiments, the exemplary energy module 304 utilizes a present acoustic signal and a previously calculated energy estimate to determine the present energy estimate.

Once the energy estimates are calculated, inter-microphone level differences (ILD) are computed in optional step 608. In one embodiment, the ILD is calculated based on the energy estimates (i.e., the energy spectrum) of both the primary and secondary acoustic signals. In exemplary embodiments, the ILD is computed by the ILD module 306.

Speech and noise components are adaptively classified in step 610. In exemplary embodiments, the adaptive classifier 308 analyzes the received energy estimates and, if available, the ILD to distinguish speech from noise in an acoustic signal.

Subsequently, the noise spectrum is determined in step 612. According to embodiments of the present invention, the noise estimates for each frequency band is based on the acoustic signal received at the primary microphone 106. The noise estimate may be based on the present energy estimate for the frequency band of the acoustic signal from the primary microphone 106 and a previously computed noise estimate. In determining the noise estimate, the noise estimation is frozen or slowed down when the ILD increases, according to exemplary embodiments of the present invention.

In step 614, noise suppression is performed. The noise suppression process will be discussed in more details in connection with FIG. 7 and FIG. 8. The noise suppressed acoustic signal may then be output to the user in step 616. In some embodiments, the digital acoustic signal is converted to an analog signal for output. The output may be via a speaker, earpieces, or other similar devices, for example.

Figure 7:
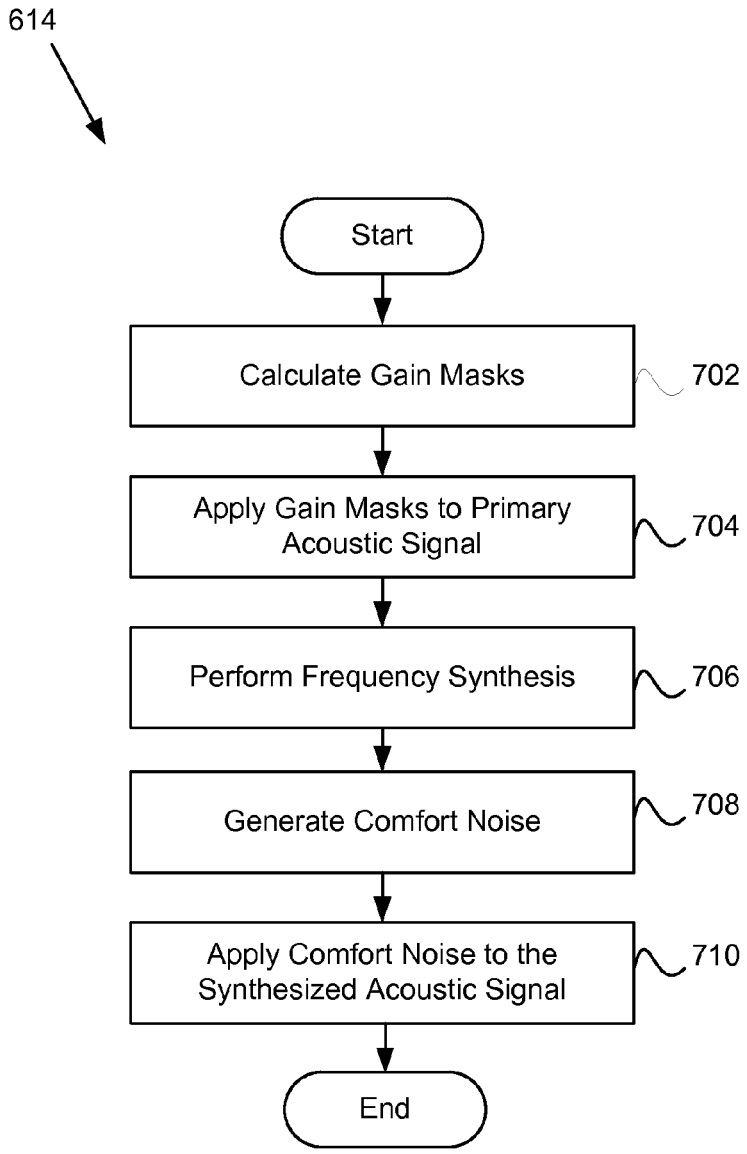
FIG. 7 is a flowchart of an exemplary method for performing noise suppression.

Referring now to FIG. 7, a flowchart of an exemplary method for performing noise suppression (step 614) is shown. In step 702, gain masks are calculated by the AIS generator 312. The calculated gain masks may be based on the primary power spectrum, the noise spectrum, and the ILD. An exemplary process for generating the gain masks will be provided in connection with FIG. 8 below.

Once the gain masks are calculated, the gain masks may be applied to the primary acoustic signal in step 704. In exemplary embodiments, the masking module 314 applies the gain masks.

In step 706, the masked frequency bands of the primary acoustic signal are converted back to the time domain. Exemplary conversion techniques apply an inverse frequency of the cochlea channel to the masked frequency bands in order to synthesize the masked frequency bands.

In some embodiments, a comfort noise may be generated in step 708 by the comfort noise generator 318. The comfort noise may be set at a level that is slightly above audibility. The comfort noise may then be applied to the synthesized acoustic signal in step 710. In various embodiments, the comfort noise is applied via an adder.

Figure 8:
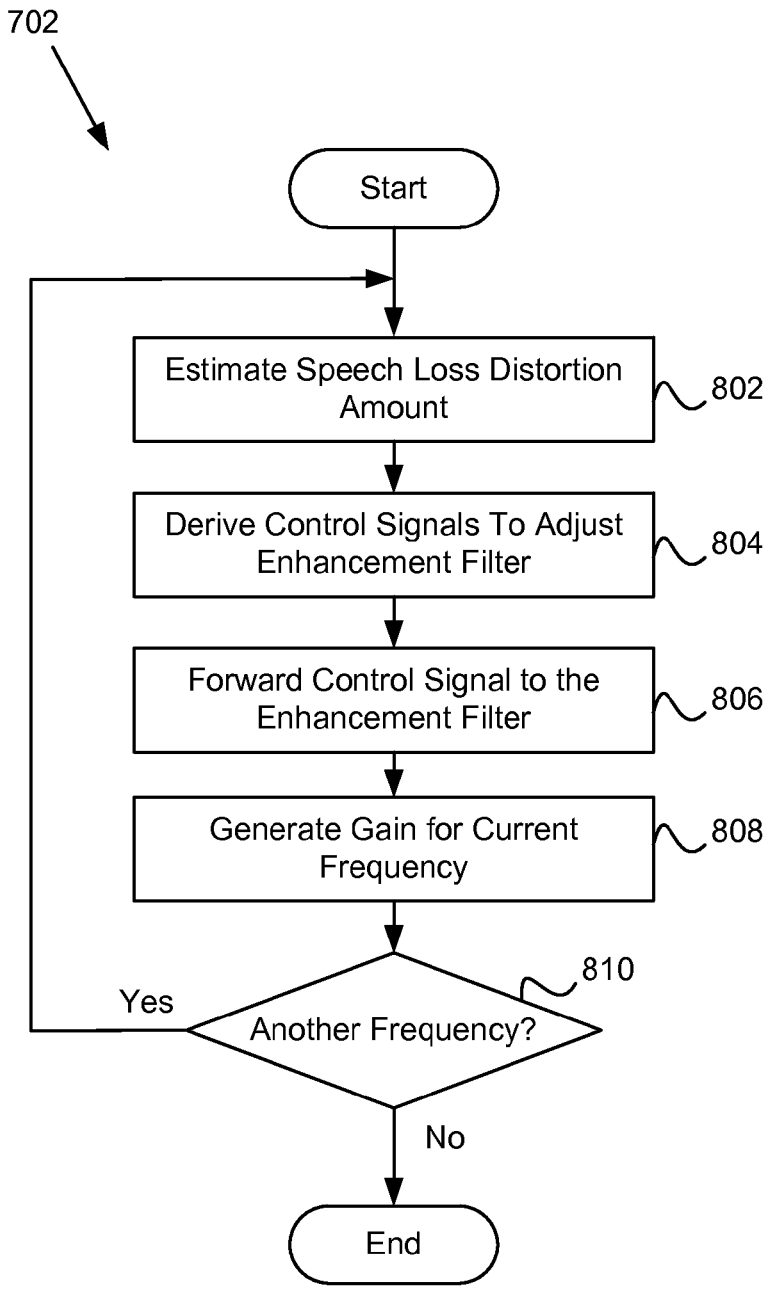
FIG. 8 is a flowchart of an exemplary method for calculating gain masks.

Referring now to FIG. 8, a flowchart of an exemplary method for calculating gain masks (step 702) is shown. In exemplary embodiments, a gain mask is calculated for each frequency band of the primary acoustic signal.

In step 802, a speech loss distortion (SLD) amount is estimated. In exemplary embodiments, the SDC module 402 determines the SLD amount by first computing an internal estimate of long-term speech levels (SL), which may be based on the primary spectrum and the ILD. Once the SL estimate is determined, the SLD estimate may be calculated. In step 804, control signals are then derived based on the SLD amount. These control signals are then forwarded to the enhancement filter in step 806.

In step 808, a gain mask for a current frequency band is generated based on a short-term signal and the noise estimate for the frequency band by the enhancement filter. In exemplary embodiments, the enhancement filter comprises a CEF module 404. If another frequency band of the acoustic signal requires the calculation of a gain mask in step 810, then the process is repeated until the entire frequency spectrum is accommodated.

While embodiments the present invention are described utilizing an ILD, alternative embodiments need not be in an ILD environment. Normal speech levels are predictable, and speech may vary within 10 dB higher or lower. As such, the system may have knowledge of this range, and can assume that the speech is at the lowest level of the allowable range. In this case, ILD is set to equal 1. Advantageously, the use of ILD allows the system to have a more accurate estimate of speech levels.

The above-described modules can be comprises of instructions that are stored on storage media. The instructions can be retrieved and executed by the processor 202. Some examples of instructions include software, program code, and firmware. Some examples of storage media comprise memory devices and integrated circuits. The instructions are operational when executed by the processor 202 to direct the processor 202 to operate in accordance with embodiments of the present invention. Those skilled in the art are familiar with instructions, processor(s), and storage media.

The present invention is described above with reference to exemplary embodiments. It will be apparent to those skilled in the art that various modifications may be made and other embodiments can be used without departing from the broader scope of the present invention. For example, embodiments of the present invention may be applied to any system (e.g., non speech enhancement system) as long as a noise power spectrum estimate is available. Therefore, these and other variations upon the exemplary embodiments are intended to be covered by the present invention.

The invention claimed is:

1. A method for adaptively controlling a noise suppressor, comprising:

receiving an acoustic signal;

determining, using at least one hardware processor, a speech loss distortion estimate based on the acoustic signal, the speech loss distortion estimate being an estimate of potential degradation of speech introduced by the noise suppressor and being a function of a signal-to-noise ratio estimate of the acoustic signal; and controlling the noise suppressor based on the speech loss distortion estimate.

2. The method of claim 1 wherein determining the speech loss distortion estimate comprises subtracting a calculated noise spectrum from a power spectrum of the acoustic signal.

3. The method of claim 2 further comprising calculating the power spectrum of the acoustic signal.

4. The method of claim 1 further comprising classifying noise and speech in the acoustic signal.

5. The method of claim 1 further comprising:

determining a level difference between the acoustic signal and another acoustic signal; and determining a control parameter and an adaptive modifier based on the level difference and the speech loss distortion estimate, wherein the controlling the noise suppressor is based on the control parameter and the adaptive modifier.

6. The method of claim 1 wherein the speech loss distortion estimate is a function of a weighting of the signal-to-noise ratio estimate of the acoustic signal.

7. The method of claim 1 wherein a gain mask of the noise suppressor is based at least in part on an adaptive modifier, the adaptive modifier being based on the speech loss distortion estimate.

8. The method of claim 1 wherein the noise suppressor is an enhancement filter having a filter equation, the filter equation being a function of a control parameter and an adaptive modifier, the control parameter and the adaptive modifier being based on the speech loss distortion estimate.

9. A system for adaptively suppressing controlling a noise suppressor, comprising:

a processor; and a memory, the memory storing a program and the program being executable by the processor to perform a method for adaptively controlling the noise suppressor, the method comprising:

receiving an acoustic signal, determining a speech loss distortion estimate based on the acoustic signal, the speech loss distortion estimate being an estimate of potential degradation of speech introduced by the noise suppressor and being a function of a signal-to-noise ratio estimate of the acoustic signal, and controlling the noise suppressor based on the speech loss distortion estimate.

10. The system of claim 9 wherein determining the speech loss distortion estimate comprises subtracting a calculated noise spectrum from a power spectrum of the acoustic signal.

11. The system of claim 9 wherein the method further comprises:

determining a level difference between the acoustic signal and another acoustic signal; and determining a control parameter and an adaptive modifier based on the level difference and the speech loss distortion estimate, the control parameter and the adaptive modifier being used for the controlling of the noise suppressor.

12. The system of claim 9 wherein the method further comprises generating a spectrum of the acoustic signal.

13. The system of claim 11 wherein the method further comprises calculating a power spectrum of the acoustic signal.

14. A non-transitory computer readable storage medium having embodied thereon a program, the program executable by a processor to perform a method for controlling a noise suppressor, the method comprising:

receiving an acoustic signal;

determining a speech loss distortion estimate based on the acoustic signal, the speech loss distortion estimate being an estimate of potential degradation of speech introduced by the noise suppressor and being a function of a signal-to-noise ratio estimate of the acoustic signal; and controlling the noise suppressor based on the speech loss distortion estimate.

15. The non-transitory computer readable storage medium of claim 14, the method further comprising:

determining a level difference between the acoustic signal and another acoustic signal; and determining a control parameter and an adaptive modifier based on the level difference and the speech loss distortion estimate, the control parameter and the adaptive modifier being used for the controlling of the noise suppressor.

16. A method for suppressing noise comprising:

receiving an acoustic signal;

determining, using at least one hardware processor, a speech loss distortion estimate based on the acoustic signal, the speech loss distortion estimate being an estimate of potential degradation of speech introduced by a noise suppressor and being a function of a signal-to-noise ratio estimate of the acoustic signal;

suppressing noise based on the speech loss distortion estimate to produce a noise suppressed signal; and generating and applying a comfort noise to the noise suppressed signal to produce an output signal.

17. The method of claim 16 wherein determining the speech loss distortion estimate comprises subtracting a calculated noise spectrum from a power spectrum of the acoustic signal.

18. The method of claim 16 wherein generating the comfort noise comprises setting the comfort noise to a level above a threshold level of audibility.

19. The method of claim 16 further comprising:

determining a level difference between the acoustic signal and another acoustic signal; and determining a control parameter and an adaptive modifier based on the level difference and the speech loss distortion estimate, the control parameter and the adaptive modifier being used for the controlling of the noise suppressor.

* * * * *